US005116431A

United States Patent [19]

Suhara et al.

[11] Patent Number: 5,116,431

[45] Date of Patent: May 26, 1992

[54] IMMERSION MEMBER FOR HOT DIP GALVANIZING BATH AND METHOD FOR PREPARING THE SAME

[75] Inventors: Michinori Suhara, Tokai; Masaaki Takagi, Nagoya; Yuuji Okuzaki, Sakura; Kuro Tashiro, Chiba; Michiyoshi Mizunuma, Nagoya, all of Japan

[73] Assignee: Taiyo Steel Co., Ltd. & Nippon Steel Hardfacing Co., Ltd., Tokyo, Japan

[21] Appl. No.: 536,562

[22] PCT Filed: Oct. 31, 1989

[86] PCT No.: PCT/JP89/01119

§ 371 Date: Jul. 3, 1990

§ 102(e) Date: Jul. 3, 1990

[87] PCT Pub. No.: WO90/05201

PCT Pub. Date: May 17, 1990

[30] Foreign Application Priority Data

Nov. 4, 1988 [JP] Japan ..... 63-278825

[51] Int. Cl.[5] ..... C25C 7/00; B32B 3/30

[52] U.S. Cl. ..... 148/530; 148/151; 148/419; 148/442; 118/419; 118/423; 428/602

[58] Field of Search ..... 148/13, 151, 408, 419, 148/429, 442; 420/440, 585; 118/419, 423, 428; 428/602

[56] References Cited

U.S. PATENT DOCUMENTS 3,035,934 5/1962 Cape ..... 420/585
3,642,519 2/1972 Tiner et al. ..... 148/142

FOREIGN PATENT DOCUMENTS 1322149 2/1963 France .
59-153875 9/1984 Japan .
1-108334 4/1989 Japan .
778539 7/1957 United Kingdom ..... 420/440

OTHER PUBLICATIONS

Patent Abstracts of Japan, vol. 5, No. 188 (C-81) (860), Nov. 27, 1981, 56-112444.
Patent Abstracts of Japan, vol. 3, No. 91 (C-54), Aug. 3, 1979, 54-69529.
Patent Abstracts of Japan, vol. 5, No. 114 (C-64) (786), Jul. 23, 1981, 56-51562.

*Primary Examiner*—George Wyszomierski
*Attorney, Agent, or Firm*—Cushman, Darby & Cushman

[57] ABSTRACT

A flame-sprayed layer comprising 1.0 to 1.5% by weight of C, 2.0 to 4.0% by weight of B, 2.0 to 4.0% by weight of Si, 1.0 to 6.0% by weight of Fe, 10.0 to 16.0% by weight of W, 5.0 to 21.0% by weight of Cr and 10.0 to 15.0% by weight of Ni, with the balance being Co, is formed on the surface of an immersion member for a hot dip galvanizing bath. This surface layer has improved corrosion resistance and abrasion resistance and an excellent peeling resistance (adhesion), and the life of the immersion member is prolonged and a galvanization product having a uniform quality and having no flaws can be prepared by using an immersion member having this flame-sprayed surface layer. These effects are enhanced when the formed flame-sprayed layer is heated at a temperature-elevating rate of 10° to 100° C./hr and maintained at a pre-heating temperature of 300° to 600° C. for at least 0.5 hour, the fusing treatment is conducted at a temperature of at least 1000° C. for up to 30 minutes once or twice, the temperature is dropped, a soaking treatment is carried out at 500° to 800° C. for at least 1 hour and a cooling treatment is then carried out at a temperature-dropping rate of 10° to 50° C./hr.

5 Claims, 4 Drawing Sheets

IMMERSION MEMBER FOR HOT DIP GALVANIZING BATH AND METHOD FOR PREPARING THE SAME

DESCRIPTION

I. Technical Field

The present invention relates to an immersion member for hot dip galvanizing bath and a method for preparing the same.

More particularly, the present invention relates to an improvement in the corrosion-resistant and abrasion-resistant properties of a roll to be immersed in a hot dip galvanizing bath, such as a sink roll or a support roll, or a constituent member thereof and also to stabilization of the quality of such a member. The present invention realizes an improvement in the corrosion resistance and abrasion resistance of a sink roll, a support roll or a bearing part or the like thereof in a hot dip galvanizing bath containing up to 5.5% by weight of Al as a bath content and stabilization of the quality thereof.

2. Background Art

Heretofore, a roll, a bearing part or the like to be used in a hot dip galvanizing bath has been produced by using a special stainless steel as its base material and flame-spraying a Co-based self-fusing alloy and a carbide cermet on said base material. However, the material thus produced is poor in corrosion-resistant and abrasion-resistant properties and inferior in stability of quality, and it tends to often cause abnormal corrosion or peeling of the flame-sprayed layer during use. Accordingly, the conventional immersion member is defective in that its life is short, and especially in case of a sink roll, this defect is serious because the working conditions are severe so that it is eagerly desired to overcome this defect. Moreover, the use of this sink roll results in a further disadvantage of formation of flaws on a product obtained by hot dip galvanizing process.

DISCLOSURE OF INVENTION

It is a general object of the present invention to eliminate the above-described defects of an immersion member to be used in a hot dip galvanizing bath.

It is a specific object of the present invention to provide an immersion member of the above kind which is superior in corrosion-resistant, abrasion-resistant and peeling-resistant properties and has a stable quality under severe conditions.

It is another specific object to provide a method for preparing an immersion member of the above kind in effective manner.

1. The present invention provides an immersion member for a hot dip galvanizing bath, which has a flame-sprayed surface layer comprising 1.0 to 1.5% by weight of C, 2.0 to 4.0% by weight of B, 2.0 to 4.0% by weight of Si, 1.0 to 6.0% by weight of Fe, 10.0 to 16.0% by weight of W, 5.0 to 21.0% by weight of Cr and 10.0 to 15.0% by weight of Ni, with the balance being Co.

2. The present invention provides an immersion for a hot dip galvanizing bath, which member has a flame-sprayed surface layer. The flame-sprayed surface layer comprises 1.0 to 1.5% by weight of C, 2.0 to 4.0% by weight of B, 2.0 to 4.0% by weight of Si, 1.0 to 6.0% by weight of Fe, 10.0 to 16.0% by weight of W, 5.0 to 21.0% by weight of Cr and 10.0 to 15.0% by weight of Ni, with the balance being Co, is formed, and then, the flame-sprayed surface layer is heated at a temperature-elevating rate of 10° to 100° C./hr, is maintained at a pre-heating temperature of 300° to 600° C. for at least 0.5 hour and is subjected to a fusing treatment by heating at a temperature of at least 1000° C. for up to 30 minutes once or twice, the temperature is dropped, a soaking treatment is carried out at a temperature of 500° to 800° C. for at least 1 hour and a cooling treatment is then carried out at a temperature-dropping rate of 10° to 50° C./hr.

3. The present invention also provides a sink roll for a hot dip galvanizing bath, which has, on the surface thereof a groove having a shape characterized by a groove depth of 0.5 to 5.0 mm, a groove width of 5.0 to 10.0 mm, a groove bottom radius of at least 5.0 mm and a groove shoulder radius of at least 3.0 mm, and has a flame-sprayed surface layer comprising 1.0 to 1.5% by weight of C, 2.0 to 4.0% by weight of B, 2.0 to 4.0% by weight of Si, 1.0 to 6.0% by weight of Fe, 10.0 to 16.0% by weight of W, 5.0 to 21.0% by weight of Cr and 10.0 to 15.0% by weight of Ni, with the balance being Co.

4. The present invention also provides a sink roll for a hot dip galvanizing bath, which has on the surface thereof a double-cross groove having a shape characterized by a groove depth of 0.5 to 5.0 mm, a groove width of 5.0 to 10.0 mm, a groove bottom radius of at least 5.0 mm, a groove shoulder radius of at least 3.0 mm and an angle of inclination of 0.3° to 5.0° to the circumferential axis of the groove, and has a flame-sprayed surface layer comprising 1.0 to 1.5% by weight of C, 2.0 to 4.0% by weight of B, 2.0 to 4.0% by weight of Si, 1.0 to 6.0% by weight of Fe, 10.0 to 16.0% by weight of W, 5.0 to 21.0 by weight of Cr and 10.0 to 15.0% by weight of Ni, with the balance being Co.

5. In the aforementioned sink roll for a hot dip galvanizing bath, the pitch of the double-cross groove is 20.0–60.0 mm in which the groove pitch is 20.0–60.0 mm.

6. The present invention also includes a method for preparing a sink roll for a hot dip galvanizing bath. This method comprises forming a flame-sprayed surface layer comprising 1.0 to 1.5% by weight of C, 2.0 to 4.0% by weight of B, 2.0 to 4.0% by weight of Si, 1.0 to 6.0% by weight of Fe, 10.0 to 16.0% by weight of W, 5.0 to 21.0% by weight of Cr and 10.0 to 15.0% by weight of Ni, with the balance being Co, on the surface of a roll having on the surface thereof a groove having a shape characterized by a groove depth of 0.5 to 5.0 mm, a groove width of 5.0 to 10.0 mm, a groove bottom radius of at least 5.0 mm and a groove shoulder radius of at least 3.0 mm, heating the flame-sprayed surface layer at a temperature-elevating rate of 10° to 100° C./hr, maintaining the flame-sprayed surface layer at a pre-heating temperature of 300° to 600° C. for at least 0.5 hour, subjecting the flame-sprayed surface layer to a fusing treatment by heating at a temperature of at least 1000° C. for up to 30 minutes once or twice, dropping the temperature, carrying out a soaking treatment at a temperature of 500° to 800° C. for at least 1 hour and carrying out a cooling treatment at a temperature-dropping rate of 10° to 50° C./hr.

7. The present invention includes another embodiment for preparing a sink roll for a hot dip galvanizing bath. This method embodiment comprises forming a flame-sprayed surface layer comprising 1.0 to 1.5% by weight of C, 2.0 to 4.0% by weight of B, 2.0 to 4.0% by weight of Si, 1.0 to 6.0% by weight of Fe, 10.0 to 16.0% by weight of W, 5.0 to 21.0% by weight of Cr and 10.0 to 15.0% by weight of Ni, with the balance being Co, on the surface of a roll having on the surface thereof a double-cross groove having a shape characterized by a groove depth of 0.5 to 5.0 mm, a groove width of 5.0 to 10.0 mm, a groove bottom radius of at least 5.0 mm, a groove shoulder radius of at least 3.0 mm and an angle of inclination of 0.3° to 5.0° to the circumferential axis of the groove, heating the flame-sprayed surface layer at a temperature-elevating rate of 10° to 100° C./hr, maintaining the flame-sprayed surface layer at a pre-heating temperature of 300° to 600° C. for at least 0.5 hour, subjecting the flame-sprayed surface layer to a fusing treatment by heating at a temperature of at least 1000° C. for up to 30 minutes once or twice, dropping the temperature, carrying out a soaking treatment at a temperature of 500° to 800° C. for at least 1 hour and carrying out a cooling treatment at a temperature-dropping rate of 10° to 50° C./hr.

Now the descriptions will be given to the reasons for limitations of the composition of the flame-sprayed surface layer. In order to complete the present invention, a testing apparatus as shown in FIG. 1 was used to perform tests on samples having a flame-sprayed surface layer of various compositions.

The reasons for limitations of the respective compositions are as described below.

C

Carbon forms a carbide dispersed in the matrix of the flame-sprayed surface layer and is effective in improving the corrosion resistance and abrasion resistance in a hot dip galvanizing bath. If the content of C is lower than 1.0% by weight, a carbide of Cr is mainly formed and the above-mentioned effect is not sufficient. If the content of C exceeds 1.5% by weight, the flame-sprayed surface layer is brittle and cracking or peeling is often caused. Accordingly, the content of C is limited to 1.0 to 1.5% by weight.

B and Si

Boron and silicon are components indispensable for imparting a self-fusing property, and they form a boride and a silicide dispersed in the matrix of the flame-sprayed surface layer and are effective in improving the corrosion resistance and abrasion resistance in a hot dip galvanizing bath. If the contents of B and Si are lower than 2.0% by weight, formation of the boride and silicide is insufficient, and if the contents of B and Si exceed 4.0% by weight, the flame-sprayed surface layer is brittle and cracking or peeling is often caused. Accordingly, the contents of B and Si are limited to 2.0 to 4.0% by weight.

Fe

Iron exerts an effect of stabilizing the matrix texture of the flame-sprayed surface layer. If the content of Fe is lower than 1.0% by weight, the above-mentioned effect cannot be obtained since the content of C in the matrix is reduced because of formation of a carbide and a boride. If the content of Fe exceeds 6.0% by weight, the amount of the formed carbide increases, and the flame-sprayed surface layer is brittle and cracking or peeling is often caused. Accordingly, the content of Fe is limited to 1.0 to 6.0% by weight.

W

Tungsten forms a boride and a carbide in the flame-sprayed surface layer and exerts an effect of improving the corrosion resistance and abrasion resistance in a hot dip galvanizing bath. If the content of W is lower than 10.0% by weight, the effect of improving the corrosion resistance by formation of the boride is reduced. If the content of W exceeds 16.0% by weight, heat cracks are liable to be formed and cracking or peeling is caused during the use, though the effect of improving the corrosion resistance and abrasion resistance by formation of the boride and carbide is attained. Accordingly, the content of W is limited to 10.0 to 16.0% by weight.

Cr

Chromium is an element forming the matrix and exerts an effect of reinforcing the matrix. If the content of Cr is lower than 5.0% by weight, the content of Cr in the matrix is reduced by formation of a carbide and the above-mentioned effect is not attained. If the content of Cr exceeds 21.0% by weight, the corrosion resistance in a hot dip galvanizing bath is reduced. Accordingly, the content of Cr is limited to 5.0 to 21.0% by weight, preferably 17.0 to 21.0% by weight.

Ni

Nickel is an element forming the matrix and is effective in increasing the toughness of the matrix and improving the workability in the deposition treatment. If the content of Ni is lower than 10.0% by weight, the resistance to heat cracking on receipt of a thermal shock is insufficient. If the content of Ni exceeds 15.0% by weight, the corrosion resistance in a hot dip galvanizing bath is reduced, though the workability in the flame-spraying treatment is improved. Accordingly, the content of Ni is limited to 10.0 to 15.0% by weight.

The present invention includes an embodiment directed to an immersion member for a hot dip galvanizing bath, which member has a flame-sprayed surface layer. The flame-sprayed surface layer comprises comprising 1.0 to 1.5% by weight of C, 2.0 to 4.0% by weight of B, 2.0 to 4.0% by weight of Si, 1.0 to 6.0% by weight of Fe, 10.0 to 16.0% by weight of W, 5.0 to 21.0% by weight of Cr and 10.0 to 15.0% by weight of Ni, with the balance being Co, is first formed. Then, the flame-sprayed surface layer is heated at a temperature-elevating rate of 10° to 100° C./hr, is maintained at a pre-heating temperature of 300° to 600° C. for at least 0.5 hour and is subjected to a fusing treatment by heating at a temperature of at least 1000° C. once or twice, the temperature is dropped, a soaking treatment is carried out at a temperature of 500° to 800° C. for at least 1 hour and a cooling treatment is then carried out at a temperature-dropping rate of 10° to 50° C./hr.

In the spraying of a self-fusing alloy, the fusing treatment is an important step determining the function of the flame-sprayed layer, and this treatment is usually accomplished by gas flame heating, heating in a furnace and high-frequency heating. However, in case of the roll for hot dip galvanizing bath, the gas flame heating is mainly adopted from the viewpoint of equipment, because the roll for a hot dip galvanizing bath has a diameter of 200 to 1000 mm and a length of 1200 to 2100 mm and has a hollow structure or solid structure. An oxygen-acetylene or oxygen-propane flame is used for the gas flame heating. Since the self-fusing alloy flame-sprayed layer has a porosity of 20 to 25% and the roll has large diameter and length, a large quantity of heat is necessary, and when a thick flame-sprayed layer having a thickness of 1 mm or more is formed, insufficient diffusion is often caused in the boundary between the base and the flame-sprayed layer. We have made research with a view to solving the problem of insufficient diffusion in the boundary between the base and the flame-sprayed layer in case of formation of a thick flame-sprayed layer having a thickness of 1 mm or more while taking it into consideration that the self-fusing alloy flame-sprayed layer has 20 to 25% of pores and the heat conductivity is reduced by the presence of these pores, and we have found a method in which the fusing treatment is carried out by using an oxygen-propylene flame having a low maximum flame temperature and the flame-sprayed layer is stabilized without degradation of the surface layer portion of the base. An example of the heat cycle in the fusing treatment of this method is illustrated in FIG. 2. FIG. 2(*a*) shows an example in which the fusing treatment is carried out once and FIG. 2(*b*) shows an example in which the fusing treatment is carried out twice. FIG. 3 shows the surface texture of a sink roll for a hot dip galvanizing bath, which is obtained by carrying out the fusing treatment according to the heat cycle shown in FIG. 2(*a*) (FIG. 3(*a*)), the surface texture of a sink roll for a hot dip galvanizing bath, which is obtained by carrying out the fusing treatment according to the heat cycle shown in FIG. 2(*b*) (FIG. 3(*b*)), and the surface texture of a conventional sink roll for a hot dip galvanizing bath, which is obtained by carrying out the conventional fusing treatment using an oxygen-acetylene flame (FIG. 3(*c*)).

As is apparent from the foregoing description, the present invention is characterized in that before the fusing treatment, the entire roll is maintained at 300° to 600° C. where diffusion of alloy components of the base is not caused and the heat loss in the fusing treatment is reduced, whereby a difference in the temperature between the surface portion of the flame-sprayed layer and the boundary portion close to the base is reduced and the quality of the flame-sprayed layer is uniformalized.

In case of a roll having large diameter and length, such as a sink roll, the heat loss is readily brought about and the difference in the texture is caused because of the difference in the temperature between the upper portion of the treated layer and the boundary portion close to the base. In order to avoid this disadvantage, it is preferred that the fusing treatment be carried out twice. According to this embodiment, in order to solve the problem of insufficient diffusion in the boundary between the flame-sprayed layer and the base in formation of a thick flame-sprayed layer, the first fusing treatment is carried out at a temperature lower by 20° to 30° C. than the appropriate treatment temperature to melt only the surface layer portion, and after the surface layer portion is brought into a state of a solid solution and the heat conductivity becomes substantially equal to the level of austenitic stainless steel, the second fusing treatment is carried out at an appropriate treatment temperature, whereby insufficient diffusion and unevenness of the grain size in the boundary portion close to the base and the difference in the texture between the surface portion and the boundary portion close to the base are eliminated.

When sink roll for a hot dip galvanizing bath, which are obtained by forming a flame-sprayed layer having a thickness of 2.5 mm and then, carrying out the machining operation so that the thickness of the flame-sprayed layer is at least 1 mm, are compared with respect to the surface texture, it is seen that, as is apparent from FIG. 3, the porosity is low in the roll obtained by carrying out the fusing treatment according to the present invention (FIG. 3(*a*)) and in the roll obtained by carrying out the fusing treatment twice, where the quantity of heat is large, the porosity is further reduced and the boride grows in the form of rods (FIG. 3(*b*)). As compared thereto in the roll obtained by carrying out the fusing treatment by using an oxygen-acetylene flame, the porosity is high, the growth of the boride is small, the quantity of heat is small and the quantity of heat used for diffusion in the boundary portion close to the base is further reduced (FIG. 3(*c*)).

In order to finely divide coarse crystal grains in the boundary diffusion layer portion of the flame-sprayed layer, the temperature in the fusing treatment after the second fusing treatment can be set at a lower level.

The present invention includes an embodiment which comprises a sink roll for a hot dip galvanizing bath, which has on the surface thereof a groove having a shape characterized by a groove depth of 0.5 to 5.0 mm, a groove width of 5.0 to 10.0 mm, a groove bottom radius of at least 5.0 mm and a groove shoulder radius of at least 3.0 mm, and has a flame-sprayed surface layer comprising 1.0 to 1.5% by weight of C, 2.0 to 4.0% by weight of B, 2.0 to 4.0% by weight of Si, 1.0 to 6.0% by weight of Fe, 10.0 to 16.0% by weight of W, 5.0 to 21.0% by weight of Cr and 10.0 to 15.0% by weight of Ni, with the balance being Co.

As the groove on the sink roll for a hot dip galvanizing bath may be formed in the shape of a spiral groove formed spirally on the surface of the roll, a symmetric groove formed spirally on the surface of the roll symmetrically with respect to the center line, or the like.

The groove shape has no direct influences on the corrosion resistance and abrasion resistance, but has influences on the quality of a product, that is, a hot dip galvanized steel sheet and on the film characteristics when a flame-sprayed surface layer is formed.

When the groove shape is provided as described herein, incorporation of the dross into the strip can be prevented while also enhancing the function of discharging zinc and the dross.

The reasons for the groove shape described elsewhere herein will now be described with reference to the results obtained with respect to various sizes in the actual operation.

Groove Depth

When the strip is kept in contact with the surface of the sink roll, a negative pressure is produced in the groove, and zinc and the dross are discharged by the pumping action. If the groove depth is smaller than 0.5 mm, the sectional area of the groove is too small and the discharging effect becomes insufficient. In contrast, if the groove depth exceeds 5.0 mm, the discharging speed is reduced and incorporation of the dross is often caused. Accordingly, the groove depth is limited to 0.5 to 5.0 mm.

Groove Width

The groove width has an effect similar to the effect of the groove depth. If the groove width is smaller than 5.0 mm, the sectional area of the groove is small and the discharging effect is insufficient. In contrast, if the groove width exceeds 10.0 mm, the discharging speed is reduced and the dross is apt to be incorporated into the strip. Accordingly, the groove width is limited to 5.0 to 10.0 mm.

Groove Bottom Radius

Since the groove bottom undergoes erosion by the discharged zinc and dross, the rounding of the bottom is indispensable. If the bottom radius is smaller than 5.0 mm, peeling of the flame-sprayed layer is readily caused by concentration of the stress, and furthermore, a groove mark is often formed. Accordingly, the groove bottom radius is limited to at least 5.0 mm, preferably 5.0 to 25.0 mm.

Groove Shoulder Radius

Since the groove shoulder undergoes erosion by the discharged zinc and dross, the rounding of the shoulder is indispensable. If the groove shoulder radius is smaller than 3 mm, a groove mark is often formed and peeling of the flame-sprayed layer is apt to be caused by concentration of the stress. Accordingly, the groove shoulder radius is limited to at least 3 mm, preferably 3.0 to 30.0 mm.

It is preferred that the groove pitch be 20 to 60 mm. If the groove pitch is adjusted to 20 to 60 mm, the problems of local erosion and incorporation of the dross can be solved in a good balance, and the quality of the strip product can be improved and the life of the sink roll can be greatly prolonged. Accordingly, in one embodiment of the invention the groove pitch is limited to 20 to 60 mm.

Another embodiment of the present invention comprises a sink roll for a hot dip galvanizing bath, which has on the surface thereof a double-cross groove having a shape characterized by a groove depth of 0.5 to 5.0 mm, a groove width of 5.0 to 10.0 mm, a groove bottom radius of at least 5.0 mm, a groove shoulder radius of at least 3.0 mm and an angle of inclination of 0.3° to 5.0° to the circumferential axis of the groove, and has a flame-sprayed surface layer comprising 1.0 to 1.5% by weight of C, 2.0 to 4.0% by weight of B, 2.0 to 4.0% by weight of Si, 1.0 to 6.0% by weight of Fe, 10.0 to 16.0% by weight of W, 5.0 to 21% by weight of Cr and 10.0 to 15.0% by weight of Ni, with the balance being Co.

Since a spiral groove generally adopted at the present has such a structure that zinc and the dross are discharged in one direction, this spiral groove is defective in that incorporation of the dross into the strip is often caused and the strip tends to meander. According to the present invention, by forming a double-cross groove as shown in FIGS. 4 and 5, the function of discharging zinc and the dross is improved and meandering of the strip can be prevented.

The reasons for limitations of the basic groove shape factors, that is, the groove depth, groove width, groove bottom radius and groove shoulder radius, are the same as those described hereinabove with respect to an above described embodiment. In a further embodiment, the groove is limited to a double-cross groove and the angle of inclination to the circumferential axis of the groove is limited to 0.3° to 5.0°.

The reason why the angle of inclination to the circumferential axis of the groove is limited as defined in the claims is as follows. If the angle is smaller than 0.3°, the crossing angle of the cross portion of the groove is too acute and hence, erosion is apt to be caused in the cross portion. In contrast, if the angle exceeds 5.0°, erosion in the cross portion is controlled, but the flow of the discharged zinc and dross is disturbed in the cross portion and incorporation of the dross is apt to be caused. Moreover, the number of groove streaks decreases and meandering of the strip is often caused.

It is preferred that the groove pitch be 20 to 60 mm. If the groove pitch is adjusted to 20 to 60 mm, the problems of local erosion and incorporation of the dross can be solved in a good balance, and the quality of the strip product can be improved and the life of the sink roll can be greatly prolonged. In a further embodiment of the present invention, the groove pitch is limited to 20 to 60 mm.

The present invention provides a method for preparing one of the aforementioned sink rolls. This method embodiment comprises forming a flame-sprayed surface layer comprising 1.0 to 1.5% by weight of C, 2.0 to 4.0% by weight of B, 2.0 to 4.0% by weight of Si, 1.0 to 6.0% by weight of Fe, 10.0 to 16.0% by weight of W, 5.0 to 21.0% by weight of Cr and 10.0 to 15.0% by weight of Ni, with the balance being Co, on the surface of a roll having on the surface thereof a groove having a shape characterized by a groove depth of 0.5 to 5.0 mm, a groove width of 5.0 to 10.0 mm, a groove bottom radius of at least 5.0 mm and a groove shoulder radius of at least 3.0 mm, heating the flame-sprayed surface layer at a temperature-elevating rate of 10° to 100° C./hr, maintaining the flame-sprayed surface layer at a pre-heating temperature of 300° to 600° C. for at least 0.5 hour, subjecting the flame-sprayed surface layer to a fusing treatment by heating at a temperature of at least 1000° C. once or twice, dropping the temperature, carrying out a soaking treatment at a temperature of 500° to 800° C. for at least 1 hour and carrying out a cooling treatment at a temperature-dropping rate of 10° to 50° C./hr.

The present invention provides a further method embodiment for preparing a sink roll for a hot dip galvanizing bath which comprises forming a flame-sprayed surface layer comprising 1.0 to 1.5% by weight of C, 2.0 to 4.0% by weight of B, 2.0 to 4.0% by weight of Si, 1.0 to 6.0% by weight of Fe, 10.0 to 16.0% by weight of W, 5.0 to 21.0% by weight of Cr and 10.0 to 15.0% by weight of Ni, with the balance being Co, on the surface of a roll having on the surface thereof a double-cross groove having a shape characterized by a groove depth of 0.5 to 5.0 mm, a groove width of 5.0 to 10.0 mm, a groove bottom radius of at least 5.0 mm, a groove shoulder radius of at least 3.0 mm and an angle of inclination of 0.3° to 5.0° to the circumferential axis of the groove, heating the flame-sprayed surface layer at a temperature-elevating rate of 10° to 100° C./hr, maintaining the flame-sprayed surface layer at a pre-heating temperature of 300° to 600° C. for at least 0.5 hour, subjecting the flame-sprayed surface layer to a fusing treatment by heating at a temperature of at least 1000° C. once or twice, dropping the temperature, carrying out a soaking treatment at a temperature of 500° to 800° C. for at least 1 hour and carrying out a cooling treatment at a temperature-dropping rate of 10° to 50° C./hr.

If a flame-sprayed surface layer is formed on a sink roll having the groove of the present invention by a conventional flame-spraying method and the fusing treatment is then carried out, it sometimes happens that insufficient diffusion is caused in the boundary portion close to the base and a desired mechanical strength cannot be obtained in the surface-treated layer. Especially, the adhesion between the flame-sprayed surface layer and the base is insufficient and hence, peeling of the flame-sprayed surface layer is caused during the use or the like or the flame-sprayed surface layer is cracked, with the result that the commercial value of the sink roll as the product is lost or the life of the sink roll is drastically shortened. Furthermore, bad influences are imposed on the quality of a strip, that is, a galvanized steel sheet, flaws and other defects are formed on the product. This unstableness of the quality is especially conspicuous in a sink roll on which a double-cross groove as specified in claim 2 or claim 5 is formed. Accordingly, development of a preparation method guaranteeing a stable quality is also an important problem to be solved.

The methods described hereinabove solve the aforementioned problems. The characteristic feature of these methods resides in the heat treatment conducted after formation of the flame-sprayed surface layer.

At first, heating is carried out at a temperature-elevating rate of 10° to 100° C./hr. If the temperature-elevating rate is higher than 100° C./hr, cracks are apt to be formed on the flame-sprayed surface layer. If the temperature-elevating rate is lower than 10° C./hr, the method becomes disadvantageous from the economical viewpoint. It is most important that pre-heating should be then carried out at 300° to 600° C. for at least 0.5 hour. The object of this treatment is to prevent cracking by the fusing treatment and attain a soaking effect. This treatment is especially important in case of a sink roll having a double-cross groove formed thereon as in the present invention. The pre-heating effect cannot be attained unless pre-heating is carried out at a temperature of 300° to 600° C. for at least 0.5 hour.

It is preferred that heating at a temperature of at least 1000° C. as the fusing treatment be carried out twice. This twice-heating method is especially recommended in the production of a sink roll having a double-cross groove formed thereon. According to this treatment, a high effect of uniformalizing the quality in the flame-sprayed layer can be attained, and if desired, the grain size can be reduced. Therefore, a desired mechanical strength can be easily obtained.

Then, the temperature is dropped and the soaking treatment is carried out at a temperature of 500° to 800° C. for at least 1 hour. If the treatment time is shorter than 1 hour, the soaking treatment is insufficient and a stable mechanical strength is hardly attained in the flame-sprayed surface layer. Then, the cooling treatment is carried out at a temperature-dropping rate of 10° to 50° C./hr. The reason is that if the temperature-dropping rate exceeds 50° C./hr, there is a risk of cracking.

The effects of the present invention are especially prominent in the production of a sink roll having a double-cross groove formed thereon.

BRIEF DESCRIPTION OF THE DRAWINGS

FIG. 2(*a*) illustrates the heat cycle in which the fusing treatment is effected once and FIG. 2(*b*) illustrates the heat cycle in which the fusing treatment is effected twice.

In FIG. 2, (1) indicates the maintenance at 500° to 550° C. for 1 hour, which is conducted before the deposition treatment, (2) represents the fusing treatment conducted at 1220° to 1250° C., (3) indicates the soaking treatment at 600° C. for 2 hours, which is conducted before the second fusing treatment, (4) represents the second fusing treatment conducted at 1250° to 1280° C., and (5) indicates the soaking treatment at 600° C. for 3 hours, which is conducted after the deposition treatment.

BEST MODE FOR CARRYING OUT THE INVENTION

Now, the invention will be explained with reference to the preferred embodiments.

EXAMPLE 1

Sink rolls, sink roll arms, immersion members and test pieces comprising a flame-sprayed surface layer having a composition shown in Table 1 and a thickness of 1 mm were prepared by flame spraying, and samples were formed by conducting the fusing treatment once or twice or without performing any fusing treatment and were tested.

Figure 2A:
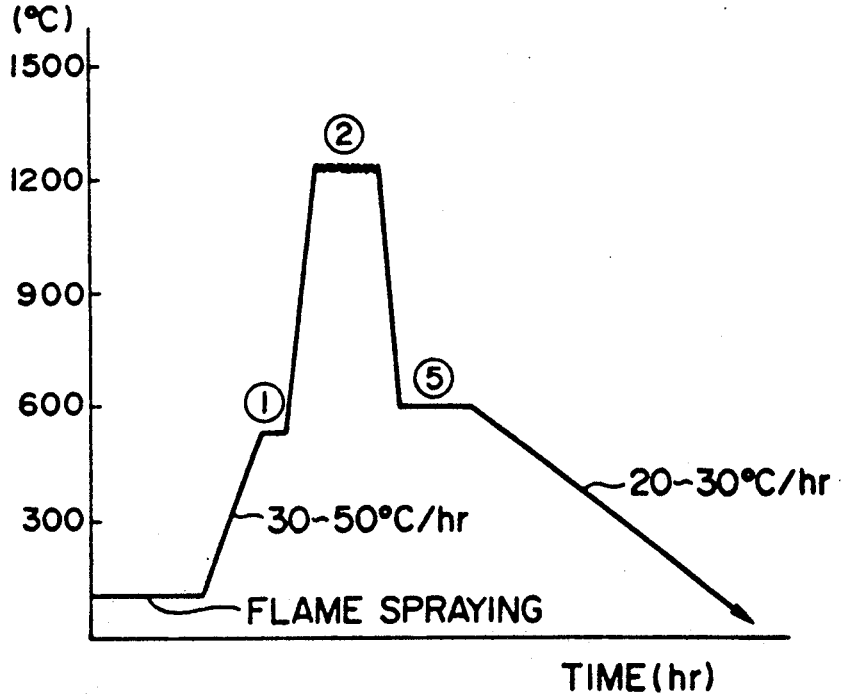
FIG. 2(*a*) and FIG. 2(*b*) illustrate heat treatment cycles in two embodiments and the invention.
Figure 2B:
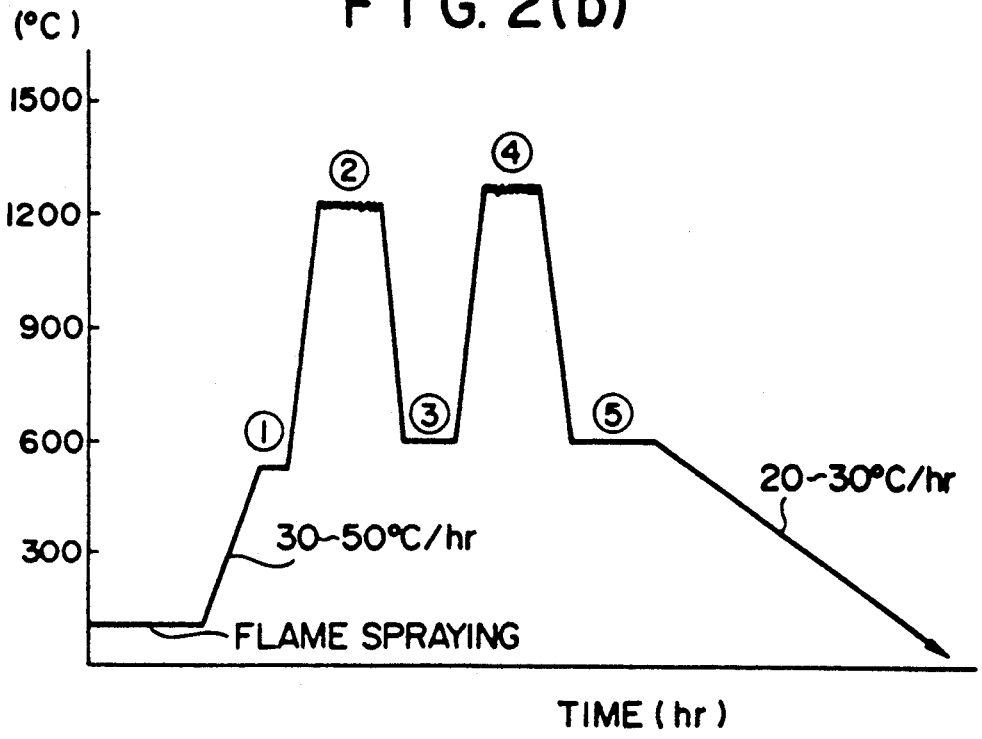

The fusing treatment conducted once was carried out according to the heat cycle shown in FIG. 2(*a*), and the fusing treatment conducted twice was carried out according to the heat cycle shown in FIG. 2(*b*).

Figure 1:
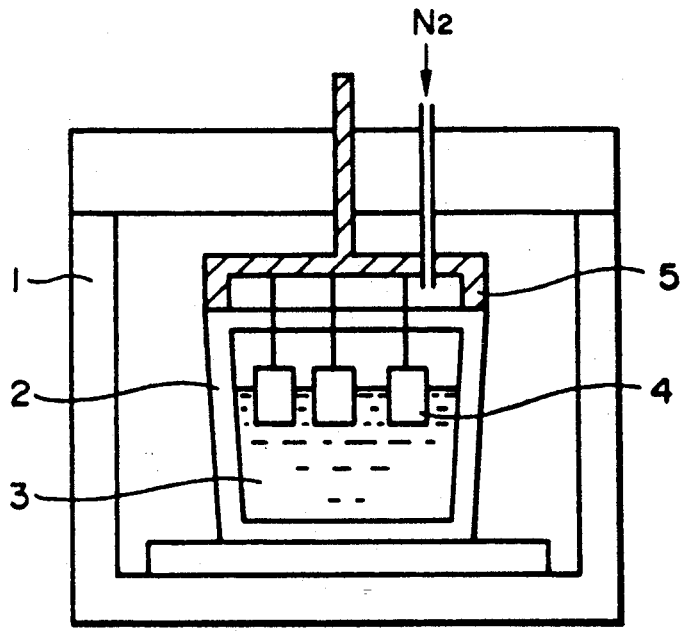
FIG. 1 is a schematic view illustrating a main portion of an apparatus for testing the corrosion in a hot dip galvanizing bath, which was used in the immersion test of the immersion members for a hot dip galvanizing bath in the examples of the present invention.

The samples were immersed in a molten zinc bath of a corrosion tester shown in FIG. 1, and the decrease of the weight by corrosion was measured. The obtained results are shown in Table 1. The test conditions are as follows:

bath temperature: 500° C.
Al content in bath: 0.27%
immersion time: 144 hours

TABLE 1

| | Sample No. | Composition (% by wt.) of Flame-Sprayed Surface Layer C | B | Si | Fe | W | Cr | Ni | Co | Fusing Treatment | Weight Decrease ($mg/cm^2$, 144 hours) by Corrosion | Surface Cracking or Peeling |
|---|---|---|---|---|---|---|---|---|---|---|---|---|
| Samples of Present Invention | 1 | 1.0 | 2.4 | 2.6 | 1.5 | 13.0 | 18.6 | 11.5 | bal. | once | 20.0 | not observed |
| | 2 | 1.3 | 2.8 | 2.7 | 3.7 | 13.5 | 18.8 | 14.3 | bal. | once | 26.2 | not observed |
| | 3 | 1.4 | 3.1 | 3.2 | 5.7 | 10.7 | 19.1 | 14.1 | bal. | twice | 24.1 | not observed |
| Comparative Samples | 11 | 0.8 | 2.5 | 2.5 | 2.0 | 12.0 | 20.0 | 12.0 | bal. | once | 37.9 | not observed |
| | 12 | 1.3 | 2.5 | 1.9 | 2.0 | 12.0 | 20.0 | 12.0 | bal. | once | 38.2 | peeling |
| | 13 | 1.3 | 2.5 | 2.5 | 0.9 | 12.0 | 20.0 | 12.0 | bal. | once | 38.1 | not observed |
| | 14 | 1.3 | 2.5 | 2.5 | 2.0 | 9.0 | 20.0 | 12.0 | bal. | none | 51.8 | not observed |
| | 15 | 1.3 | 2.5 | 2.5 | 2.0 | 9.0 | 22.0 | 12.0 | bal. | none | 39.7 | not observed |
| | 16 | 1.3 | 2.5 | 2.5 | 2.0 | 9.0 | 20.0 | 9.0 | bal. | once | 41.2 | peeling |
| | 17 | 0.7 | 3.0 | 2.4 | 0.7 | 7.2 | 18.5 | 13.1 | bal. | once | 56.9 | not observed |
| | 18 | 1.1 | 2.5 | 2.8 | 0.9 | 9.6 | 18.4 | 13.7 | bal. | once | 52.1 | not observed |
| | 19 | 1.2 | 2.8 | 2.9 | 1.7 | 13.5 | 18.8 | 17.1 | bal. | once | 64.0 | not observed |
| Conventional Sample | 20 (12%-Cr Stainless Steel) | 0.15 | — | 1.4 | bal. | 0.15 | 11.5 | 0.15 | Mo. 0.1 | — | 278.8 | not observed |

Note
The thickness of the flame-sprayed layer was 1 mm in each sample.

EXAMPLE 2

Immersion members for a hot dip galvanizing bath, such as sink rolls, comprising a flame-sprayed 7 surface layer having a composition shown in Table 2 and a thickness of 1.2 mm were formed by flame-spraying, and samples were prepared by conducting the fusing treatment once or twice or without performing any fusing treatment and were subjected to the actual operation test.

The fusing treatment conducted once was carried out according to the heat cycle shown in FIG. 2(*a*), and the fusing treatment conducted twice was carried out according to the heat cycle shown in FIG. 2(*b*).

It was found that the corrosion resistance and abrasion resistance were improved in the immersion members for a hot dip galvanizing bath, such as sink rolls, and therefore, the life was greatly prolonged.

The results of the actual operation test of the immersion members for a hot dip galvanizing bath, such as sink rolls, are shown in Table 2.

EXAMPLE 3

Figure 4:
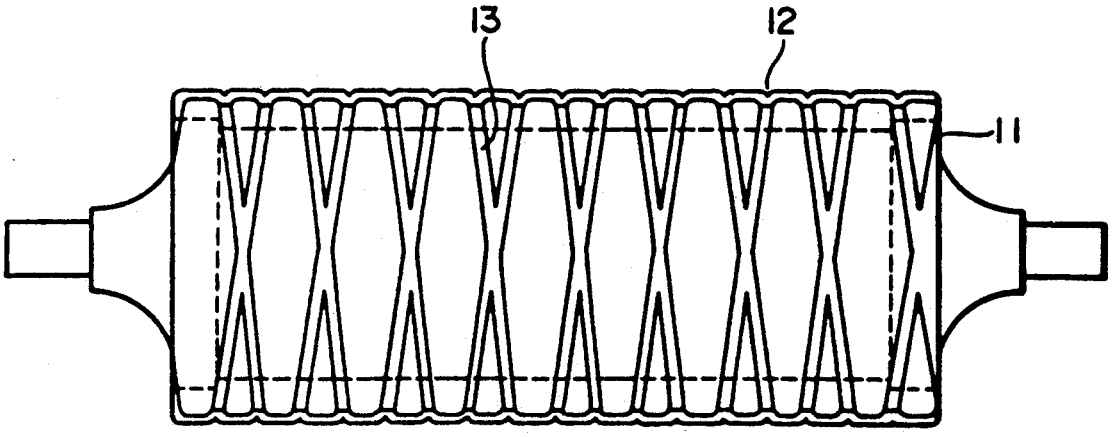
FIG. 4 is a diagram showing an embodiment of the sink roll according to the embodiments of the present invention.
Figure 3A:
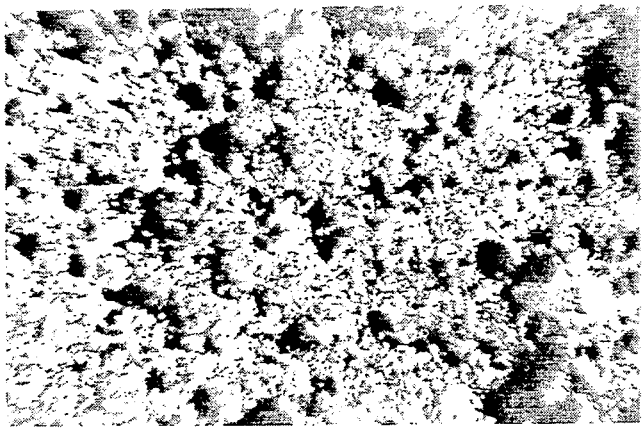
FIG. 3(*a*), FIG. 3(*b*) and FIG. 3(*c*) show micrographs of surface metal textures of sink rolls of Example 2 of the present invention and Comparative Example, in which FIG. 3(*a*) shows the surface metal texture of a sink roll for a hot dip galvanizing bath, which was obtained by forming a flame-sprayed surface layer having a thickness of 2.5 mm and conducting the fusing treatment according to the heat treatment cycle shown in FIG. 2(*a*), FIG. 3(*b*) shows the surface metal texture of a sink roll in a hot dip galvanizing bath, which was obtained by forming a flame-sprayed surface layer having a thickness of 2.5 mm and conducting the fusing treatment twice according to the heat treatment cycle shown in FIG. 2(*b*), and FIG. 3(*c*) shows the surface metal texture of a sink roll for a hot dip galvanizing bath, which was obtained by forming a flame-sprayed surface layer having a thickness of 2.5 mm and conducting the conventional fusing treatment using an oxygen-acetylene flame. In each of the sink rolls shown in FIG. 3(*a*), 3(*b*) and 3(*c*) after the fusing treatment, the machining operation was carried out so that the thickness of the flame-sprayed layer was at least 1 mm. Etching was carried out by using an alkaline solution of red prussiate of potash, and the magnification of each micrograph is 100.
Figure 3B:
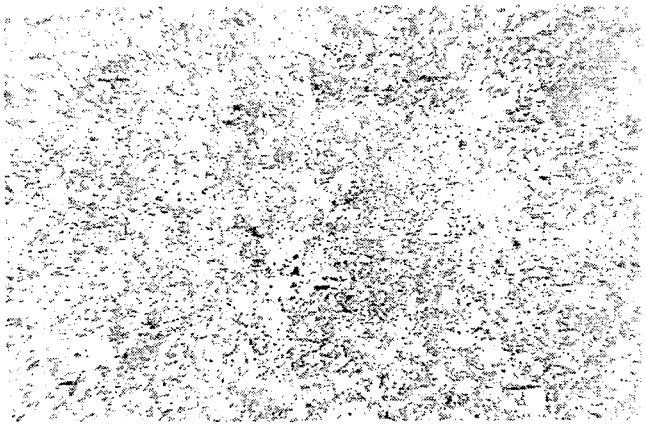
Figure 3C:
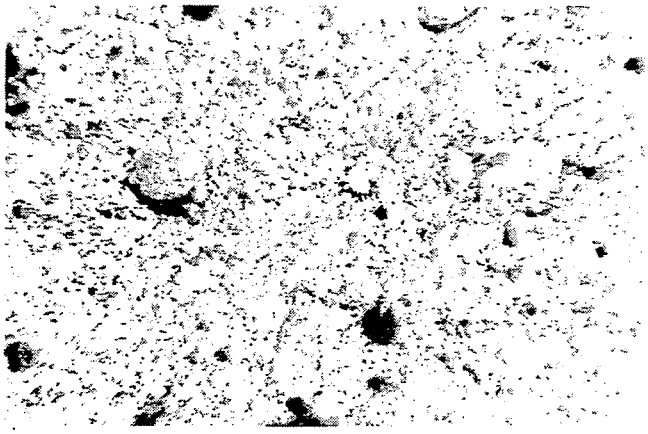
Figure 5:
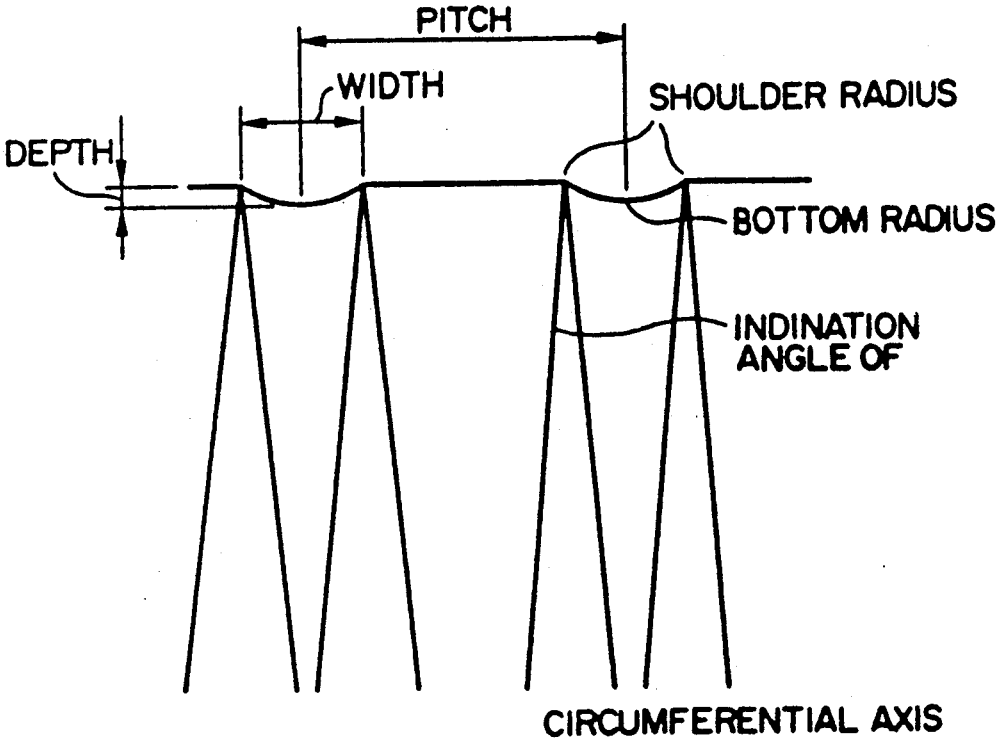
FIG. 5 is a diagram illustrating an example of the shape of the double-cross groove formed on the surface of the sink roll of the present invention.
Figure 6:
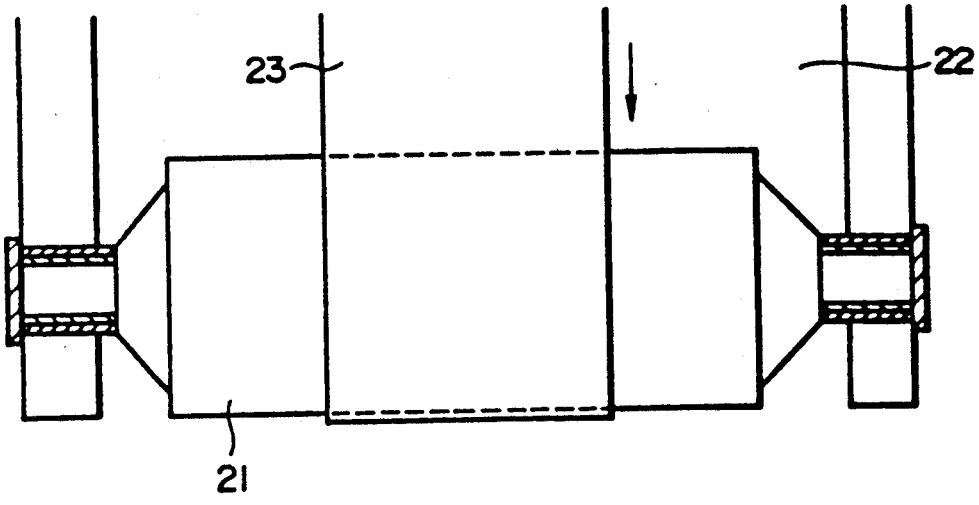
FIG. 6 is a diagram showing the state of the use of sink rolls for a hot dip galvanizing bath, obtained in Examples 2 and 3, and other immersion members for a hot dip galvanizing bath.

A flame-sprayed surface layer having a composition shown in Table 3 and a thickness of 1 mm was formed on sink rolls for a hot dip galvanizing bath, on which a double-cross groove shown in FIGS. 4 and 5 was formed, and also on sink rolls for a hot dip galvanizing bath, on which an ordinary spiral groove was formed. Samples were formed by conducting the fusing treatment once or twice or without performing any fusing treatment and were tested. It was found that neither slipping nor meandering of the strip was caused and the quality of a galvanized steel sheet as the product was improved.

The results of the use test of respective sink rolls in a hot dip galvanizing bath are shown in Table 3.

The standards of evaluation of meandering (walking), the quality of the obtained galvanized steel sheet as the product and the durability are shown in the following tables.

Standard of Evaluation of Meandering (Walking)

TABLE 2

| | Composition (% by wt.) of Flame-Sprayed Surface Layer C | B | Si | Fe | W | Cr | Ni | Co | Fusing Treatment | Kind of Immersion Member | State of Use | Life |
|---|---|---|---|---|---|---|---|---|---|---|---|---|
| Samples of Present Invention | 1.3 | 2.8 | 2.7 | 3.7 | 13.5 | 18.8 | 14.3 | bal. | twice | sink roll | uniform surface | 150 to 180 days |
| | 1.3 | 2.8 | 2.7 | 3.7 | 13.5 | 18.8 | 14.3 | bal. | twice | shaft and bearing | smooth rotation | 40 to 50 days |
| | 1.3 | 2.8 | 2.7 | 3.7 | 13.5 | 18.8 | 14.3 | bal. | once | sink roll arm and zinc melting box | no substantial corrosion | 340 to 370 days |
| Comparative Samples | 1.2 | 2.8 | 2.9 | 1.7 | 13.5 | 18.8 | 17.1 | bal. | once | sink roll | surface roughing | 20 to 30 days |
| | 1.3 | 2.5 | 2.5 | 0.9 | 12.0 | 20.0 | 12.0 | bal. | once | sink roll | local surface roughing | 30 to 40 days |
| | 0.7 | 3.0 | 2.4 | 0.7 | 7.2 | 18.5 | 13.1 | bal. | once | sink roll | surface roughing | 20 to 30 days |
| | 1.3 | 2.5 | 2.5 | 2.0 | 9.0 | 2.0 | 12.0 | bal. | once | sink roll | surface roughing | 20 to 40 days |
| | 1.1 | 2.5 | 2.8 | 0.9 | 9.6 | 18.4 | 13.7 | bal. | once | shaft and bearing | local corrosion | 30 to 40 days |
| | 0.8 | 2.5 | 2.5 | 2.0 | 12 | 20.0 | 12.0 | bal. | none | sink roll arm and zinc melting box | local corrosion | 100 to 130 days |
| Conventional Samples (12%-Cr Stainless Steel) | 0.15 | — | 1.4 | bal. | 0.15 | 11.5 | 0.15 | Mo, 0.1 | — | sink roll | great change of profile | 5 to 6 days |
| | 0.15 | — | 1.4 | bal. | 0.15 | 11.5 | 0.15 | Mo, 0.1 | — | shaft and bearing | great local corrosion | 5 to 6 days |
| | 0.15 | — | 1.4 | bal. | 0.15 | 11.5 | 0.15 | Mo, 0.1 | — | sink roll arm and zinc melting box | great local corrosion | 30 to 40 days |

Note
1) The life of the sink roll is expressed by the number of days, during which the roll could be used without grinding (the sink rolls of the present invention could be used continuously without grinding of the roll surface if the shaft and bearing were exchanged periodically).
2) The thickness of the flame-sprayed layer was 1.2 mm in each sample.

-continued

| Evaluation Point | Meandering (Walking) |
|---|---|
| 3 | no meandering caused |
| 2 | slight meandering observed |
| 1 | conspicuous meandering observed |

Standard of Quality of Product

| Evaluation Point | Quality of Product |
|---|---|
| 3 | product having a good appearance obtained |
| 2 | slight flaws observed |
| 1 | conspicuous flaws observed |

Standard of Evaluation of Durability

| Evaluation Point | Durability |
|---|---|
| 3 | more than 120 days |
| 2 | 20 to 120 days |
| 1 | less than 20 days |

TABLE 3

| | Composition (% by wt.) of Flame-Sprayed Surface Layer | | | | | | | | Fusing | | Meandering | Quality | |
|---|---|---|---|---|---|---|---|---|---|---|---|---|---|
| | C | B | Si | Fe | W | Cr | Ni | Co | Treatment | Grooving | (Walking) | of Product | Durability |
| Samples of Present Invention | 1.3 | 2.8 | 2.7 | 3.7 | 13.5 | 18.8 | 14.3 | bal. | twice | double-cross groove | 3 | 3 | 3 |
| | 1.3 | 2.8 | 2.7 | 3.7 | 13.5 | 18.8 | 14.3 | bal. | twice | spiral groove | 2 | 3 | 3 |
| Comparative Samples (Ordinary Self-Fusing Alloys) | 1.2 | 2.8 | 2.9 | 1.7 | 13.5 | 18.8 | 17.1 | bal. | once | double-cross groove | 3 | 2 | 2 |
| | 1.2 | 2.8 | 2.9 | 1.7 | 13.5 | 18.8 | 17.1 | bal. | once | spiral groove | 2 | 2 | 2 |
| | 0.7 | 3.0 | 2.4 | 0.7 | 7.2 | 18.5 | 13.1 | bal. | once | double-cross groove | 3 | 2 | 2 |
| | 0.7 | 3.0 | 2.4 | 0.7 | 7.2 | 18.5 | 13.1 | bal. | once | spiral groove | 2 | 2 | 2 |
| Comparative Samples (12%-Cr Stainless Steel) | 0.15 | — | 1.4 | bal. | 0.15 | 11.5 | 0.15 | Mo. 0.1 | — | double-cross groove | 3 | 1 | 1 |
| | 0.15 | — | 1.4 | bal. | 0.15 | 11.5 | 0.15 | Mo. 0.1 | — | spiral groove | 2 | 1 | 1 |

Note
The thickness of the flame-sprayed layer was 1 mm in each sample.

We claim:

1. A sink roll for a hot dip galvanizing bath, which has on the surface thereof a groove having a shape characterized by a groove depth of 0.5 to 5.0 mm, a groove width of 5.0 to 10.0 mm, a groove bottom radius of at least 5.0 mm and a groove shoulder radius of at least 3.0 mm, and has a flame-sprayed surface layer comprising 1.0 to 1.5% by weight of C, 2.0 to 4.0% by weight of B, 2.0 to 4.0% by weight of Si, 1.0 to 6.0% by weight of Fe, 10.0 to 16.0% by weight of W, 5.0 to 21.0% by weight of Cr and 10.0 to 15.0% by weight of Ni, with the balance being Co.

2. A sink roll for a hot dip galvanizing bath, which has on the surface thereof a double-cross groove having a shape characterized by a groove depth of 0.5 to 5.0 mm, a groove width of 5.0 to 10.0 mm, a groove bottom radius of at least 5.0 mm, a groove shoulder radius of at least 3.0 mm and an angle of inclination of 0.3° to 5.0° to the circumferential axis of the groove, and has a flame-sprayed surface layer comprising 1.0 to 1.5% by weight of C, 2.0 to 4.0% by weight of B, 2.0 to 4.0% by weight of Si, 1.0 to 6.0% by weight of Fe, 10.0 to 16.0% by weight of W, 5.0 to 21.0% by weight of Cr and 10.0 to 15.0% by weight of Ni, with the balance being Co.

3. A sink roll for a hot dip galvanizing bath according to claim 1 or 2, wherein the groove has a pitch of 20.0 to 60.0 mm.

4. A method for preparing a sink roll for a hot dip galvanizing bath which comprises:

providing a sink roll having on the surface thereof a groove having a shape characterized by a groove depth of 0.5 to 5.0 mm, a groove width of 5.0 to 10.0 mm, a groove bottom radius of at least 5.0 mm and a groove shoulder radius of at least 3.0 mm, forming a flame-spayed surface layer comprising 1.0 to 1.5% by weight of C, 2.0 to 4.0% by weight of B, 2.0 to 4.0% by weight of Si, 1.0 to 6.0% by weight of Fe, 10.0 to 16.0% by weight of W, 5.0 to 21.0% by weight of Cr and 10.0 to 15.0% by weight of Ni, with the balance being Co, on the surface of said sink roll, heating the flame-sprayed surface layer at a temperature-elevating rate of 10° to 100° C./hr, maintaining the flame-sprayed surface layer at a preheating temperature of 300° to 600° C. for at least 0.5 hour, subjecting the flame-sprayed surface layer to at least one fusing treatment by heating at a temperature of at least 1000° C. for up to 30 minutes, dropping the temperature of the flame-sprayed surface layer, carrying out a soaking treatment of the flame-sprayed surface layer at a temperature of 500° to 800° C., for at least 1 hour, and carrying out a cooling treatment of the flame-sprayed surface layer at a temperature-dropping rate of 10° to 50° C. hr.

5. A method for preparing a sink roll for a hot dip galvanizing bath which comprises:

providing a sink roll having on the surface thereof a double-cross groove having a shape characterized by a groove depth of 0.5 to 5.0 mm, a groove width of 5.0 to 10.0 mm, a groove bottom radius of at least 5.0 mm, a groove shoulder radius of at least 3.0 mm, and an angle of inclination of 0.3° to 5.0° to the circumferential axis of the groove, forming a flame-sprayed surface layer comprising 1.0 to 1.5% by weight of C, 2.0 to 4.0% by weight of B, 2.0 to 4.0% by weight of Si, 1.0 to 6.0% by weight of Fe, 10.0 to 16.0% by weight of W, 5.0 to 21.0% by weight of Cr and 10.0 to 15.0% by weight of Ni, with the balance being Co, on the surface of said sink roll, heating the flame-sprayed surface layer at a temperature-elevating rate of 10° to 100° C./hr, maintaining the flame-sprayed surface layer at a preheating temperature of 300° to 600° C. for at least 0.5 hour, subjecting the flame-sprayed surface layer to at least one fusing treatment by heating at a temperature of at least 1000° C. for up to 30 minutes, dropping the temperature of the flame-sprayed surface layer, carrying out a soaking treatment of said surface layer at a temperature of 500° to 800° C. for at least 1 hour, and carrying out a cooling treatment of said surface layer at a temperature-dropping rate of 20° to 50° C./hr.

* * * * *